US005339553A

United States Patent [19]

Kearns

[11] Patent Number: 5,339,553

[45] Date of Patent: Aug. 23, 1994

[54] SELF-REMOVING COVER FOR PERCUSSION TYPE FIREARMS

[76] Inventor: Robert M. Kearns, 5435 N. Hertford Way, Boise, Id. 83703

[21] Appl. No.: 76,216

[22] Filed: Jun. 14, 1993

[51] Int. Cl.[5] ..... F41C 9/08

[52] U.S. Cl. ..... 42/83

[58] Field of Search ..... 42/83; 89/30

[56] References Cited

U.S. PATENT DOCUMENTS

| | | | |
|---|---|---|---|
| 19,213 | 1/1858 | Smith | 42/83 |
| 35,418 | 5/1862 | Haskins | 42/83 |
| 42,621 | 5/1864 | Lilly | 42/83 |
| 91,014 | 6/1869 | Hay et al. | 42/83 |
| 93,733 | 8/1869 | Moore | 42/83 |
| 96,112 | 10/1869 | Hill et al. | 42/83 |
| 4,485,577 | 12/1984 | Lunders | 42/83 |

*Primary Examiner*—Stephen C. Bentley
*Attorney, Agent, or Firm*—Paul F. Horton

[57] ABSTRACT

A self-removing cover guard for muzzle leading firearms of the type having a nipple for receiving a percussion cap. The cover guard includes a plate or cup secured to the breech or drum of the firearm by the nipple; a spring loaded hinge connected at one end to the plate or cup; and a nipple cover affixed to the other end of the hinge for pivotal placement or displacement of the nipple cover on or off the nipple. The spring, which may be integral with the hinge, is biased to automatically remove the nipple cover off the nipple, and hence the percussion cap, when the firearm hammer is retracted from its un-cocked, cover holding, position. A sealant may be provided between the nipple cover and the nipple or cup to protect the percussion cap from moisture.

14 Claims, 2 Drawing Sheets

SELF-REMOVING COVER FOR PERCUSSION TYPE FIREARMS

BACKGROUND OF THE INVENTION

1. Field of the Invention

This invention relates to percussion cap covers, in general, and, more particularly, to self removing covers.

2. Background of the Invention

Muzzle loading firearms are currently in vogue largely because of their historical interest. Of the varying types of muzzle loaders, the percussion cap type of firearm is the most popular amongst muzzle loader enthusiasts. In the percussion cap type firearm, a nipple is provided for receiving the percussion cap. The nipple most generally is threaded into the breech of the firearm and includes a bore communicating with the muzzle for ignition of black powder, or other explosive, which has been ram-rodded into the breech from the muzzle. The hammer of the firearm strikes the percussion cap, held in place on the nipple, to commence the firing procedure.

It is important that the percussion cap, an explosive primer, be kept dry for actuation and, as a safety measure, it is important that the cap be protected from being accidentally struck by the hammer or other object which may well result in firing of the firearm.

For this reason, a variety of percussion cap protectors have been invented. Early guards include those of D. W. Smith, U.S. Pat. No. 19,213; J. Haskins, U.S. Pat. No. 35,418; and B. Lilly, U.S. Pat. No. 42,621. Smith discloses a thimble for covering the percussion cap and nipple, which is automatically removed by a lever mechanism when the hammer is moved from a half-cock to a full-cock position. Haskins discloses a protector constructed of rubber for stretching over the percussion cap. The protector of Haskins is attached to the gun by a chain to prevent loss of the protector. Lilly discloses a snap cap which rotates in and out of position. A more recent invention by R. K. Lunders, U.S. Pat. No. 4,485,577 discloses a removable cover which rests against the breech of a firearm and a seal to prevent moisture from dampening the percussion cap.

As shown by Smith, it is highly desirable that the protector be automatically removed by cocking the hammer of the firearm to reduce firing time, once game is spotted. For aesthetics, as well as for convenient operation, it is important that mounting of a percussion cap guard not mutilate the firearm or require a gunsmith as does the Smith device. It is also important that a self-removing guard have a minimum of mechanical parts.

SUMMARY OF THE INVENTION

The present invention provides a protective cover for a percussion cap and for the nipple holding the percussion cap to prevent accidental discharge of the firearm and also to keep the percussion cap dry for firing integrity. The cover of the present invention is provided with a spring loaded hinge which automatically removes the cover upon cocking of the hammer; a cover which is affixed to the breech of the firearm by the existing nipple, without mutilation of the firearm; a cover which operates with a minimum of parts; and a cover which is prevented from accidental loss by its hinge connection to the nipple.

Additional objects and advantages will become apparent and a more thorough and comprehensive understanding may be had from the following description taken in conjunction with the accompanying drawings forming a part of this specification.

BRIEF DESCRIPTION OF THE DRAWINGS

Preferred embodiments of the present invention are illustrated by the accompanying drawings.

DETAILED DESCRIPTION OF THE INVENTION

Figure 1:
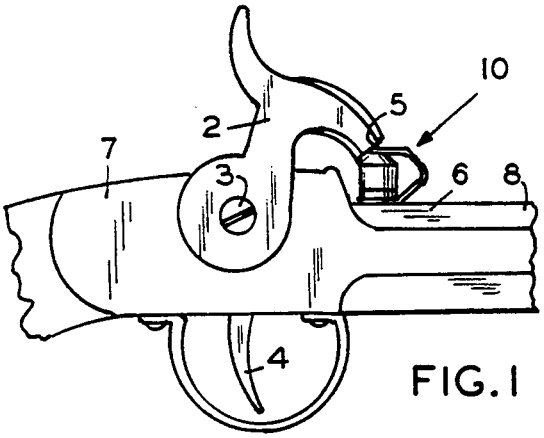
FIG. 1 is a fragmentary side view, in partial section, of a percussion type firearm showing a guard of the present invention held in place by the hammer of the firearm over the percussion cap and nipple.
Figure 2:
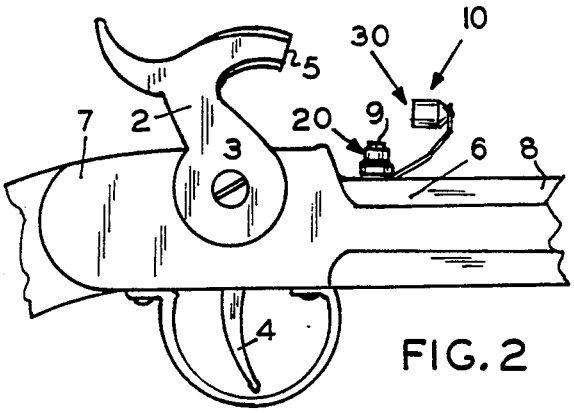
FIG. 2 is a view similar to that of FIG. 1, but showing the present guard in a retracted non-protective position by cocking of the hammer.

Referring now to FIGS. 1 and 2, a first embodiment 10 of the present invention is shown, as mounted on an existing percussion cap firearm 7. A typical firearm, such as the one shown, includes a hammer 2 mounted on a tumbler screw 3 for arcuate movement from a cocked position as shown in FIG. 2 to an uncocked striking position, as shown in FIG. 1, upon actuation by trigger 4. The head 5 of hammer 2 is operable to strike a percussion cap 9 received by and held upon a nipple 20. The explosion of the percussion cap flash ignites through a bore in the nipple and breech 6, not shown, black powder which has been ram rodded into the muzzle 8 of the firearm for firing a projectile.

Figure 3:
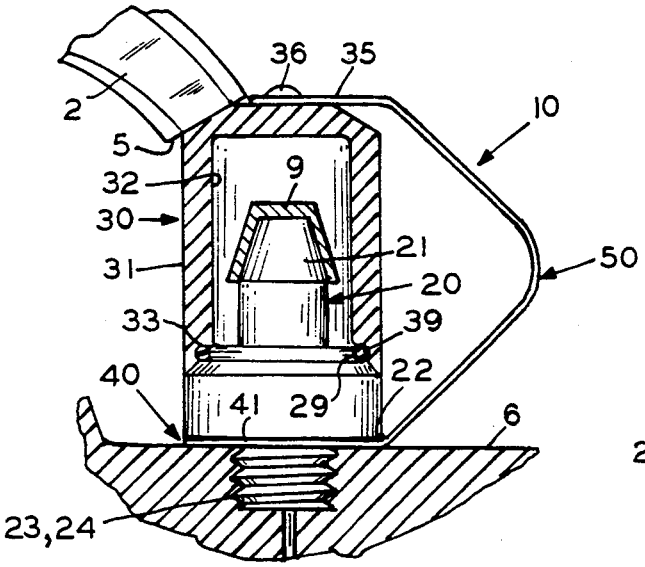
FIG. 3 is a sectional side view of a first embodiment of the present invention shown in the protective mode.

Nipple 20, conventionally, includes a cone-shaped head over which is fitted percussion cap 9, shown to advantage in FIG. 3. The nipple includes a shoulder 22 and threads 24 extending below the shoulder for engaging mating threads within an aperture of breech 6. Shoulder 22 normally rests firmly against the top surface of the breech when the nipple is completely threaded into the breech.

Figure 4:
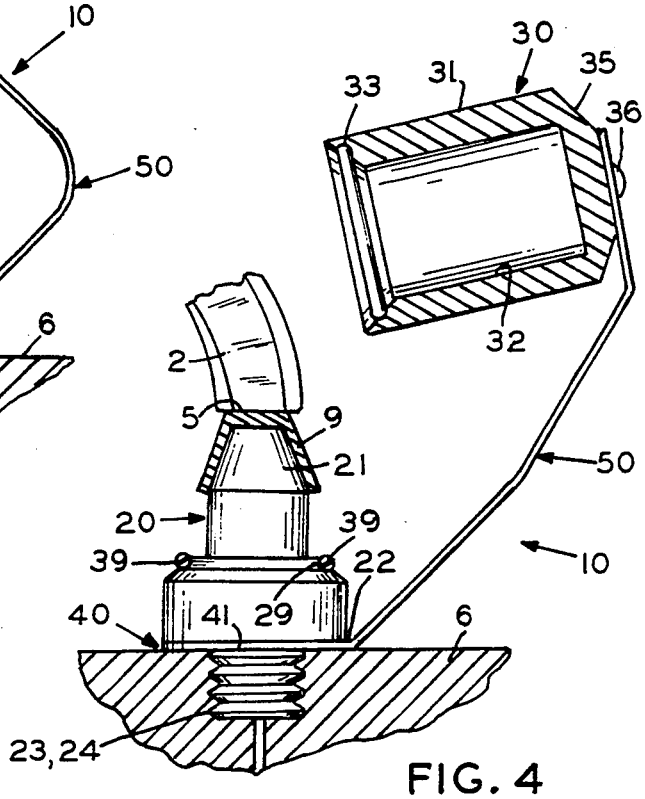
FIG. 4 is a sectional side view of the guard of FIG. 3 shown in the retracted, non-protective mode.
Figure 8:
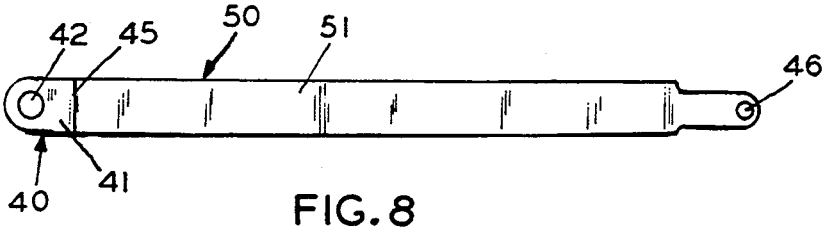
FIG. 8 is a plan view of one embodiment of an integral hinge, spring, and guard connector.

Referring now to FIGS. 3, 4, and 8, the first embodiment of a nipple guard 10 is shown in more detail. Nipple guard 10 includes, generally, a nipple cover 30; guard connection means designated by the numeral 40; and hinge means designated by the numeral 50.

Nipple guard 10, in both first and second embodiments, is connected to the firearm and held in place by nipple 20. In the first embodiment, guard connection means 50 includes a plate member 41 having planar opposing surfaces and defining an aperture 42 for receiving the threaded shank 23 of the nipple. The top surface of the plate member is fitted against the bottom surface of should 22 of the nipple 20 and the bottom surface of the plate member engages the top surface of breech 6 of the firearm. In this manner, when the nipple is completely screwed into the breech, nipple guard 10 is held firmly in place. In this description and in the appended claims, the term "breech" also is contemplated to include the term "drum".

Nipple cover 30, in the first embodiment, includes a sidewall 31, preferably annular, defining a bore 32 dimensioned to receive nipple 20 and percussion cap 9. The bore, at its uppermost end, is terminated by a lid 35 to which is connected, by screw 36 or otherwise, hinge means 50. Bore 32 is open at the opposing lowermost end for reception of the nipple and percussion cap. Adjacent its lowermost end, sidewall 31 defines an annular groove 33, substantially hemispherical in cross section, for receiving an O-ring 39 mounted in an annular groove 29 on nipple 20 for sealing engagement between the nipple and nipple cover 30. It is obvious that resilient gaskets or other types of sealants may likewise be employed to prevent moisture from dampening the percussion cap. Lid 35 of cover 30, preferably is beveled so as to make flush contact with the head 5 of hammer 2 of the firearm, which holds the cover 30 in a closed protective position over the nipple and percussion cap 9, as shown in FIG. 3. The nipple cover 30 may be constructed of any suitable material, it being preferred that the nipple be constructed of a soft metal so as to prevent scarring of the hammer head.

Hinge means 50, in the first embodiment, and shown to advantage in FIG. 8, taken in conjunction with FIGS. 3 and 4, comprises a tension spring 51, preferably a steel leaf spring—the spring being integral with the hinge and also integral with guard connection means 40. The spring may be appropriately crimped at its juncture 45 with guard connection means 40 and with its connection with lid 35, as well as other suitable locations, for desired pivotal placement and displacement of the nipple cover over the nipple and percussion cap. Hinge means 50 is biased by the spring to the open, unprotective position, as shown in FIG. 4 and assumes this position when not held in the close position, under tension, by hammer 5. The end of the hinge, opposite guard connection means 40, is provided with an aperture for reception of screw 36, when a screw is used for connecting hinge and cover.

While metal is preferred for construction of nipple cover 30, hinge 50, and guard connection means 40, because of traditional use of wood and metal only, it is obvious that the cover, hinge, and guard connection means could be integrally constructed of molded plastic of appropriate resiliency and still work in the same manner.

Figure 5:
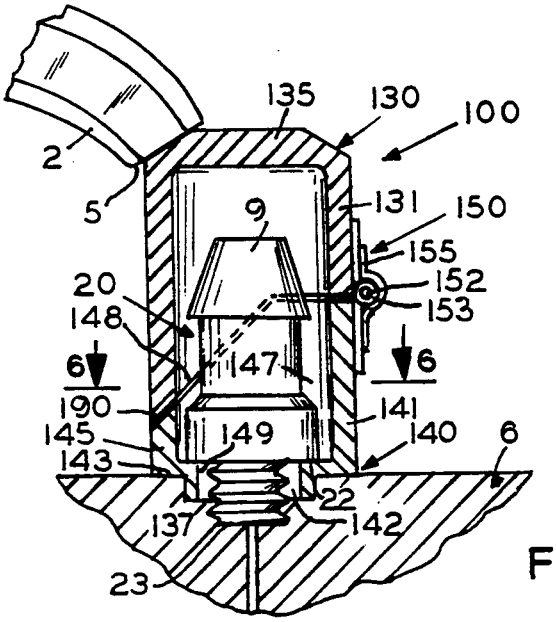
FIG. 5 is a sectional side view of a second embodiment of the present invention, shown in the protective mode.
Figure 7:
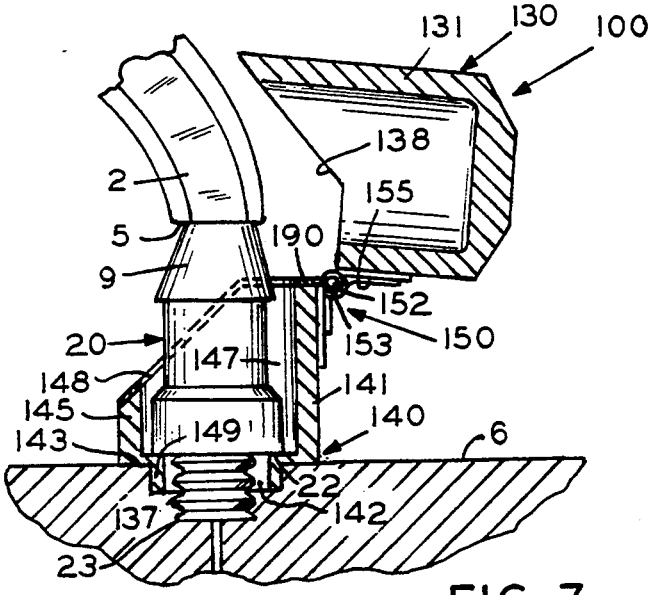
FIG. 7 is a sectional side view of the embodiment shown in FIG. 5, shown in the retracted non-protective mode.
Figure 6:
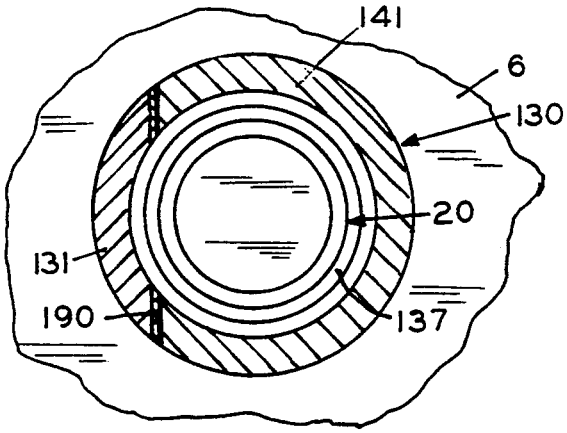
FIG. 6 is a cross-sectional view taken along lines 6—6 of FIG. 5.

Referring now to FIGS. 5, 6, and 7, a second embodiment of a nipple guard 100 made according to the present invention may be seen to advantage. Nipple guard 100 includes a nipple cover 130; guard connection means 140 and hinge means designated by the numeral 150.

Guard connection means 140 includes a cup member 145 having a base portion 143 defining an aperture 142 through which is fitted the threaded portion 23 of nipple 20. Base portion 143 of the cup member is caused to engage shoulder 22 of nipple 20 and the top surface of breech 6 of the firearm and is held therebetween much in the manner described in regards to the first embodiment. The cup member 145 may be provided with a downwardly depending sleeve 149 for fitting into a recess conventionally provided in the breech. The cup member is provided with an annular sidewall 141 extending upwardly from the base and defining a top opening bore 147 for receiving the top portion of the nipple. Sidewall 141 includes a beveled portion 148 for receiving a mating beveled portion 138 of cover 130. The top surfaces of sidewall 141 may be provided with a gasket 190, or other sealant, for preventing the entry of moisture within the cup member and cover to keep the percussion cap 9 dry.

Nipple cover 130 includes a sidewall 131 defining a bottom opening bore 137 for receiving the top portion of nipple 20 and percussion cap 9. The top of the bore is sealed by lid 135 which is preferably provided with an outer surface beveled for flush engagement with head 5 of hammer 2, when the cover is in the closed protective mode.

Connecting nipple cover 130 to guard connection means 140 is hinge means 150, which may be of simple pin 152, sleeve 153, construction as is conventional with hinges. Hinge means 150 includes a spring 155 biased to maintain the cover 130 in an open unprotective position, as shown in FIG. 7. Hammer 2, in the uncocked position, holds the cover in the protective mode, as shown in FIG. 5.

Nipple cover 130, cup member 145, and hinge 150 are all preferably constructed of metal, but, like the first embodiment, may be constructed of plastic. Spring 155 may be separate from hinge 150, as shown, but may also be integral with hinge 150 and may also be integral with cup 145 and cover 130.

It will be seen, then, that in both embodiments, the nipple cover is held in place, under spring tension, by uncocked hammer 2. Once the hammer is cocked, the cover is automatically removed by means of the spring as the cover pivots from its closed position to the open position by means of the hinge, thus uncovering the nipple, with mounted percussion cap, for firing of the firearm by means of contact between hammer head and percussion cap.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A nipple guard for percussion firearms having a breech into which is mounted a nipple for receiving a percussion cap engagable by a firearm hammer, said guard comprising:

a nipple cover for covering the percussion cap held on the nipple;

guard connection means mountable on the nipple for securing the guard to the nipple; and hinge means extending between and connecting said nipple cover to said guard connection means for pivotal placement and displacement of said nipple cover over the nipple and hence over the percussion cap.

2. The nipple guard as described in claim 1 wherein said hinge means includes a spring for holding said nipple cover in a normally open, unprotective position with respect to the nipple and percussion cap; said spring biased under tension when said nipple cover is held in a closed protective position over the nipple and percussion cap by the hammer.

3. The nipple guard as described in claim 2 wherein said spring is integral with said hinge means.

4. A nipple guard for percussion firearms having a breech into which is threaded a nipple provided with a shoulder; said nipple operable to receive a percussion cap engageable by a firearm hammer, said guard comprising:

a nipple cover for covering the percussion cap held on the nipple;

guard connection means including a plate member defining an aperture for placement of a threaded portion of the nipple therethrough, said plate member mounted between the shoulder of the nipple and the breech for securing the guard to the nipple; and hinge means extending between and connecting said nipple cover to the plate member of said guard connection means for pivotal placement and displacement of said nipple cover over the nipple and hence over the percussion cap.

5. The nipple guard as described in claim 4 wherein said hinge means includes a spring for holding said nipple cover in a normally open, unprotective position with respect to the nipple and percussion cap; said spring biased under tension when said nipple cover is held in a closed protective position over the nipple and percussion cap by the hammer.

6. The nipple guard as described in claim 5 wherein said spring is integral with said hinge means and said plate member of said guard connection means.

7. The nipple guard as described in claim 4 further comprising sealant means between the nipple and said nipple cover to prevent moisture from contacting the percussion cap.

8. A nipple guard for percussion firearms having a breech into which is threaded a nipple provided with a shoulder; said nipple operable to receive a percussion cap engageable by a firearm hammer, said guard comprising:

a nipple cover for covering the percussion cap held on the nipple;

guard connection means including a cup member having a base portion and a side portion defining a top opening, said base portion defining an aperture for placement of a threaded portion of the nipple therethrough, said base member mountable between the shoulder of the nipple and the breech of the firearm for securing the cup member to the firearm and said cup member mateably engageable with said nipple cover to provide an enclosure about the percussion cap when in a closed mode; and hinge means connecting said nipple cover to said cup member of said guard connection means for pivotal placement and displacement of said nipple cover over the nipple and hence over the percussion cap.

9. The nipple guard as described in claim 8 wherein said hinge means includes a spring for holding said nipple cover in a normally open, unprotective position with respect to the nipple and percussion cap; said spring biased under tension when said nipple cover is held in a closed protective position over the nipple and percussion cap by the hammer.

10. The nipple guard as described in claim 9 wherein said spring is integral with said hinge means.

11. The nipple guard as described in claim 10 wherein said spring is further integral with said cup member.

12. The nipple guard as described in claim 11 wherein said spring is further integral with said nipple cover.

13. The nipple guard as described in claim 8 further comprising sealant means between said cup member and said nipple cover for preventing moisture from dampening the percussion cap.

14. The nipple guard as described in claim 8 wherein said nipple cover and said cup member of said guard connection means are each provided with beveled sidewalls matingly engagable with one another.

* * * * *